United States Patent [19]

Black et al.

[11] 4,435,031

[45] Mar. 6, 1984

[54] CONNECTOR BLOCK WITH SNAP LATCH

[75] Inventors: Richard W. Black; Erol M. Kirayoglu; Harold E. Leiter; Richard C. Smith, all of Spartanburg, S.C.

[73] Assignee: Holmberg Electronics Corporation, Inman, S.C.

[21] Appl. No.: 337,667

[22] Filed: Jan. 7, 1982

[51] Int. Cl.[3] ..... H01R 9/09

[52] U.S. Cl. ..... 339/17 C; 339/17 LC; 339/DIG. 1; 403/292

[58] Field of Search ..... 339/17 C, 17 LM, 17 M, 339/17 LC, DIG. 1, 276 SF; 46/26, 29, 31; 403/408, 292, 297, 298

[56] References Cited

U.S. PATENT DOCUMENTS

| | | | |
|---|---|---|---|
| 2,442,754 | 6/1948 | Beam | 248/27 |
| 2,542,144 | 2/1951 | Kearns | 85/40 |
| 2,885,822 | 5/1959 | Onanian | 46/31 |
| 3,154,281 | 10/1964 | Frank | 46/31 |
| 3,220,078 | 11/1965 | Preziosi | 24/221 |
| 3,487,350 | 12/1969 | Hammell | 339/17 |
| 3,538,240 | 11/1970 | Sherlock | 174/88 |
| 3,634,814 | 1/1972 | Inacker | 339/17 LM |
| 3,688,635 | 9/1972 | Fegen | 339/17 R |
| 3,723,943 | 3/1973 | Hotze | 339/17 CF |
| 3,772,632 | 11/1973 | Rattcliff et al. | 339/17 CF |
| 3,999,827 | 12/1976 | Hutchison et al. | 339/17 CF |
| 4,037,915 | 7/1977 | Cabaud | 339/276 SK |
| 4,052,118 | 10/1977 | Scheingold et al. | 339/17 CF |
| 4,068,346 | 1/1978 | Binder | 403/292 |
| 4,093,330 | 6/1978 | Pittman | 339/17 CF |
| 4,159,592 | 7/1979 | Gabriel | 46/26 |
| 4,174,563 | 11/1979 | Simpson | 339/DIG. 1 |
| 4,186,988 | 2/1980 | Kobler | 339/17 C |
| 4,188,085 | 2/1980 | Aldridge et al. | 339/17 CF |
| 4,211,466 | 7/1980 | Reynolds | 339/276 SF |
| 4,295,696 | 10/1981 | Gray | 339/17 C |
| 4,351,580 | 9/1982 | Kirkman et al. | 339/17 CF |
| 4,373,826 | 2/1983 | Inamoto et al. | 403/14 |

FOREIGN PATENT DOCUMENTS

| | | | |
|---|---|---|---|
| 2646561 | 4/1978 | Fed. Rep. of Germany | 46/26 |
| 1440121 | 6/1976 | United Kingdom | 339/DIG. 1 |
| 721570 | 3/1980 | U.S.S.R. | 403/292 |

*Primary Examiner*—John McQuade
*Assistant Examiner*—Gary F. Paumen
*Attorney, Agent, or Firm*—Thomas Hooker

[57] ABSTRACT

A snap latch for securing a connector block on a circuit board or like support includes a central portion and prongs extending to either side of central portion. The prongs on one side of the central portion extend through a bore in a circuit board mounting portion to secure the snap latch to the block. The prongs on the other side of the central portion extend through a circuit board hole and secure the snap latch and block to the circuit board. The latch may be heat-shrunk to clamp the block to the board.

5 Claims, 8 Drawing Figures

CONNECTOR BLOCK WITH SNAP LATCH

This application relates to a snap latch for securing a connector block on a circuit board or the like and particularly to a molded plastic snap latch having flexible prongs with latches on the ends of the prongs. The prongs may be inserted through a circuit board hole to bring the latches into engagement with the opposite side of the board so that they snap back and secure the block in place on the board. The snap latch may include a second set of prongs so that one set of prongs holds the latch on the connector block and the second set of prongs holds the latch and block on the circuit board. The latch is preferably formed of heat-shrink plastic material so that after the block is mounted on the board, heating of the latch shrinks it longitudinally to form a tight connection between the block and board.

Conventionally, connector blocks and circuit elements are permanently attached to the circuit boards by a nut and bolt type connection as shown in U.S. Pat. Nos. 4,052,118 and 4,188,085. Alternatively, removable latch-type connections may be used as shown in U.S. Pat. Nos. 3,772,632 and 3,999,827. Heat-shrink plastic sleeves have been used to clamp free ends of conductors against terminal posts, as shown in U.S. Pat. No. 4,174,563.

Other objects and features of the invention will become apparent as the description proceeds, especially when taken in conjunction with the accompanying drawings illustrating the invention, of which there are two sheets and three embodiments.

IN THE DRAWINGS

DESCRIPTION OF THE INVENTION

Figure 1:
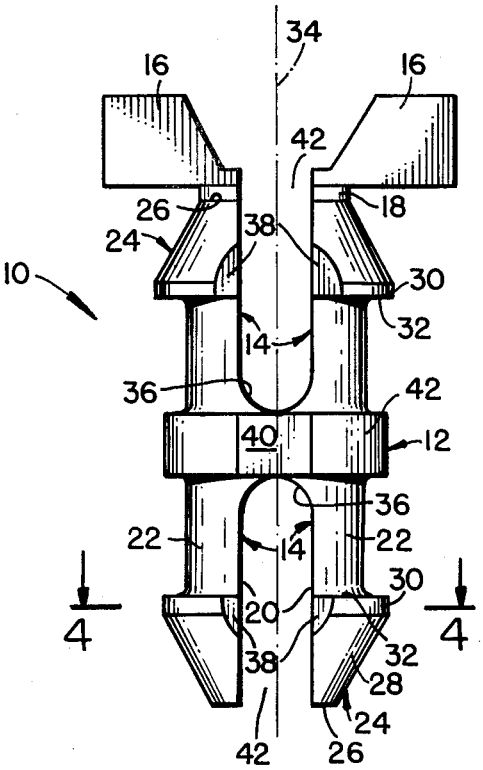
FIG. 1 is a side view of a connector block snap latch.
Figure 2:
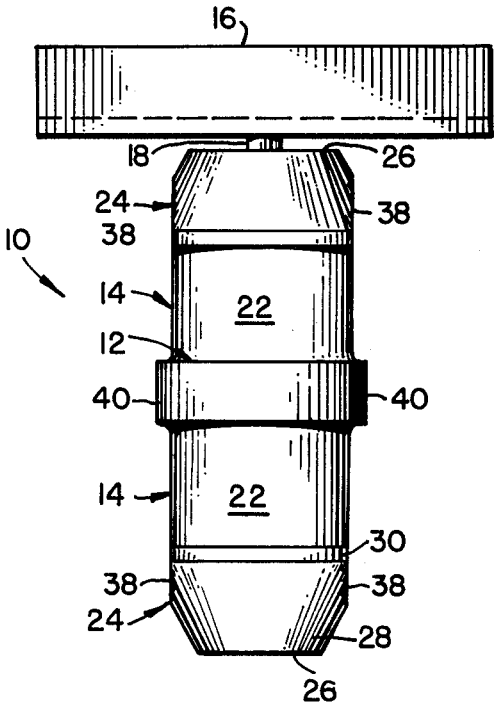
FIG. 2 is a second side view of the snap latch taken 90° to that of FIG. 1.
Figure 3:
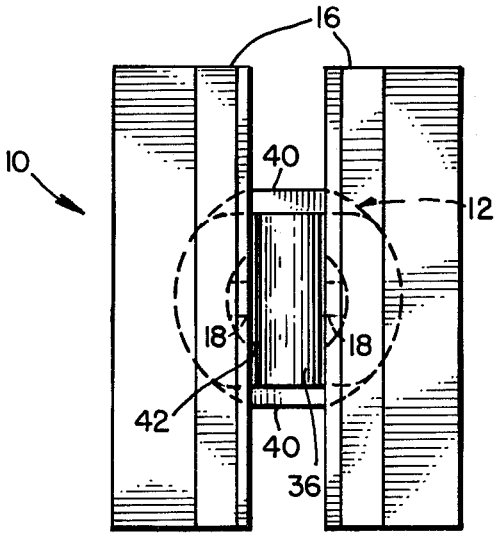
FIG. 3 is a top view of FIG. 1.
Figure 4:
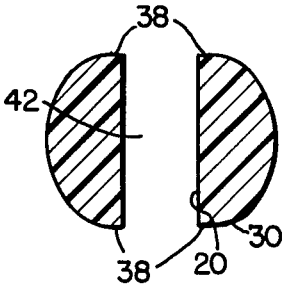
FIG. 4 is a sectional view taken along line 4—4 of FIG. 1.

Connector block snap latch 10 shown in FIGS. 1 through 4 is preferably molded from a resilient plastic material and includes a generally cylindrical central portion 12 with a pair of opposed flexible prongs 14 extending away from opposite sides of the central portion. Breakaway orienting tabs 16 are integral with the ends of one pair of the prongs 14. As shown in FIG. 2, the tabs extend transversely to either side of the snap latch and are secured to the ends of the prongs by narrow breakaway sections 18.

Each prong 14 includes a flat inner wall 20, a partial cylindrical outer side wall 22 extending from the central portion outwardly and a latch 24 on the end of the prong. Each latch includes a flat end 26 at the free end of the prong, a partial frustoconical cam surface 28 sloping radially outwardly from the end 26, a partial cylindrical surface 30 at the outer edge of the cam surface and a latching shoulder 32 extending radially inwardly from the surface 30 to side wall 22.

The side walls 22 of adjacent prongs 14 lie on a common, cylindrical surface having an axis on the longitudinal axis 34 of the snap latch. Likewise, the frustoconical surfaces 28 and cylindrical surfaces 30 of adjacent prongs lie on cylindrical and conical surfaces having axes on axis 34. Flat inner walls 20 extend from end walls 26 to a full radius cylindrical surface 36 tangent with the inner walls and the adjacent end surface of the central portion 12. Flats 38 are formed on the inner ends of latches 24 adjacent walls 20 so that, as illustrated in FIG. 2, the width of the latch is equal or less than the width of the prongs 14. Flats 40 are provided on the sides of the central portion 12 adjacent the sides of slots 42 between prongs 14.

Snap latch 10 is preferably molded from a plastic material such as nylon or polyester. The polyester plastic may be glass filled, if desired. The mold used for forming the latch 10 includes gates at flats 40 for flowing plastic into the mold cavity. Flats 40 are below the cylindrical surface of the central portion, thereby assuring that any roughness on the flats does not extend beyond the cylindrical surface 42 and, as a result, cannot interfere with mounting of the latch on a connector block.

The plastic forming snap latch 10 is treated to shrink when it is heated to a high temperature, such as during contact with a molten solder bath. The plastic shrinks and, as a result, the distances between the latching surfaces 32 on either end of the snap latch and the central portion 12 are reduced.

Figure 5:
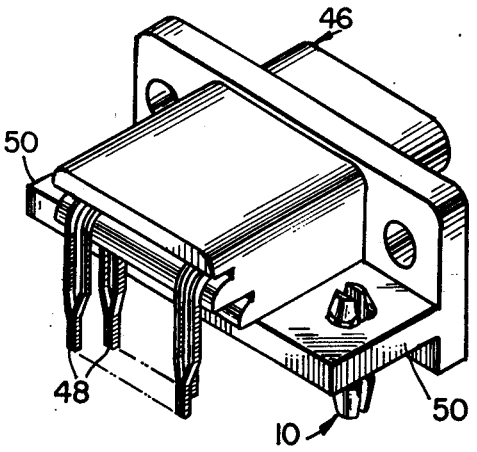
FIG. 5 is a perspective view showing a snap latch mounted on a connector block.
Figure 6:
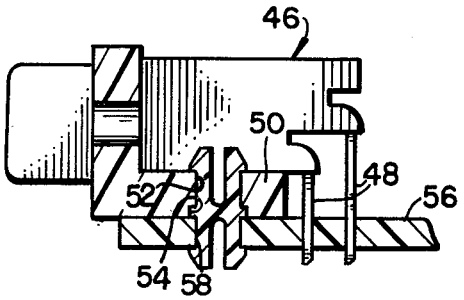
FIG. 6 is a sectional view illustrating a snap latch securing a connector block to a circuit board.

Snap latches 10 are used to mount connector blocks, or other circuit elements, on supports such as circuit boards. FIG. 5 illustrates a conventional connector block 46 comprising a plastic body with a series of terminals confined within the body for mating with suitable circuit elements. Terminal tails 48 extend below mounting portions 50 located to either side of the central terminal-carrying part of the block. The portions 50 are each provided with a latch-receiving bore 52 having an enlarged step 54 at its lower end. A snap latch 10 is fitted in each bore 52 as illustrated in FIG. 6. This operation may be performed manually or automatically by a suitable loading apparatus.

When the snap latches are attached to the block manually, an operator picks up individual snap latches as illustrated in FIGS. 1 through 4 by holding tabs 16, pilots the latch ends away from the tabs into the step end of bore 52 and then pushes the latch into the bore so that the cam surfaces 28 flex the two prongs inwardly toward each other and the prongs pass through the bore 52 and snap back as illustrated in FIG. 6 with latching shoulders 32 engaging the top surface of the mounting portion 50. In this position, the outer surfaces 22 of prongs 14 rest flush on the surface of bore 52. Cylindrical portion 12 fits flush within step 54 and cooperates with the latching surfaces 32 to secure the snap latch on the mounting portion and assure it is held in place during mounting of the block onto a circuit board or other suitable support member. The tabs 16 are broken away at sections 18 and discarded.

Following receiving the two snap latches 10 on block 46, the block is positioned above a circuit board 56, the terminal tails 48 are piloted into circuit board holes and the free ends of the snap latches 10 are piloted into large diameter circuit board bores 58 having a diameter equal to the diameter of surface 22 of the exposed prongs 14.

The block is then pushed down toward the circuit board so that the tails extend into the circuit board holes and the latches on the ends of the prongs are flexed together, moved through bore 58 and snap back against the lower surface of the board, thereby mounting the connector block 46 on the circuit board 56 as shown in FIG. 6. The lower surface of the block rests on the upper surface of the board. The central portion 12 of the snap latch is fully seated within the step 54 so that it does not interfere with the surface-to-surface engagement between the block and the board.

The minimum diameter of cam surface 28 at the free end of each pair of prongs is less than the diameter of surfaces 22, thereby permitting free piloting of the latches into the bore. The width of slot 42 is sufficient to permit the prongs and latches to be bent in toward each other and pass through the bore 52 or hole 58 having a diameter equal to the diameter of surface 22. In practice, the width of the slot 42 must be greater than the difference in diameters between the cylindrical surfaces 30 and 22 to allow sufficient room for inward bending of the prongs.

The flats 38 assure the edges and the latches adjacent slot 42 clear the bore or hole. Inward bending of the prongs does not move these portions of the latches away from the bore or hole, thus necessitating the flats 38. Full radius surface 36 provides a thickening of the prongs adjacent the central portion to reduce stress concentration at the junction between the prongs and the central portion and stiffens the prongs.

Alternatively, the snap latches 10 may be machine-mounted by feeding them to a loading machine, holding the snap latches beneath a ram so that the free ends of the latches are above bore 52 and then extending the ram into the slot 42 between the tabs to seat against the bottom of the slot, break sections 18 and force the latch into the bore.

After the block is mounted on the board, the lower surface of the circuit board is wave soldered to form electrical solder connections between the terminal tails and circuit elements on the board. The molten solder heats the heat-shrink snap latches 10 to shrink the snap latches longitudinally thereby tightening the connection between the snap latches and the mounting portions of the blocks and the circuit board. In this way the block is securely mounted on the board despite the inevitable dimensional variations which occur in the manufacture of the snap latches, block and board. The secure mounting of the block on the board is automatically achieved without the need to devote separate attention to securing each mounting portion of the block on the board, as is conventional where blocks are mounted on circuit boards by nut and bolt connections.

Figure 7:
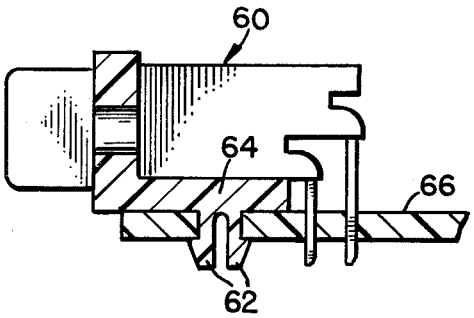
FIG. 7 is a sectional view similar to FIG. 6 illustrating a snap latch integral with a block.

FIG. 7 illustrates a second embodiment of the invention wherein connector block 60, similar to block 46, includes a molded plastic body with integral pairs of flexible prongs 62 extending downwardly from the mounting portions 64 on each side of the central terminal-carrying portion. The prongs 62 are like flexible prongs 14 of snap latch 10 and are formed of similar heat-shrink plastic. Following loading of terminals into block 60, the connector block is mounted on circuit board 66 in exactly the same manner that block 46 is mounted on board 56. Wave soldering of board 66 heat-shrinks the prongs 62 so that the block is securely mounted on the board.

Figure 8:
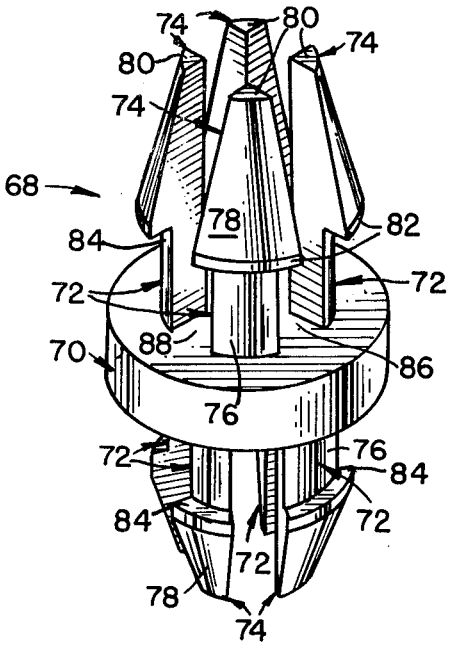
FIG. 8 is perspective view of a snap latch different from the latch of FIGS. 1 through 6.

FIG. 8 illustrates snap latch 68 similar to latch 10 having a cylindrical portion 70 and four flexible prongs 72 extending to either side of the central portion. Each prong carries a latch 74 on its free end. The prongs and latches 72 and 74 are similar to the prongs and latches 14 and 24 of snap latch 10. Prongs 72 include outer partial cylindrical surfaces 76 and latches 74 include outer partial frustoconical surfaces 78, fat ends 80, partial cylindrical surfaces 82 and latching surfaces 84. The prongs on each side of the central portion are separated from adjacent prongs by two right angle cross grooves 86 and 88 which permit inward radial flexing of the prongs as they are passed through bores in a connector block, circuit board or like-mounting member.

The latches 74 at the top of snap latch 68 are longer than those at the bottom of the latch to define shallower, less steep cam surfaces 78. The shallow angled cam surfaces permit easy insertion of the prongs into circuit board holes. This is important when blocks carrying the snap latches are manually mounted on circuit boards. The latches of snap latch 10 which are moved through circuit board hole 58 are longer than the latches moved through bores 52.

The prongs of snap latch 68 are more flexible than the prongs of snap latch 10 so that the latch is more easily inserted into bores on a connector block and the block carrying the snap latch is more easily mounted on the circuit board. The thicker prongs of latch 10 provided improved pull out and shear resistance than the prongs of latch 68 and, accordingly, may be used in applications where the connection between the block and the board is likely to be highly stressed.

One example of this is when two snap latches hold a multi-terminal block in place on a board and must be sufficiently strong to transmit insertion and withdrawal forces to the board as contacts are mated with and removed from the terminals in the block.

The snap latch 68 may be formed from the same plastic material as latch 10 and is treated to shrink when exposed to molten solder. In this way, latch 68 tightly draws the block and board together, as described in connection with snap latch 10.

While we have illustrated and described a preferred embodiment of our invention, it is understood that this is capable of modification, and we therefore do not wish to be limited to the precise details set forth, but desire to avail ourselves of such changes and alterations as fall within the purview of the following claims.

What we claim our invention is:

1. The combination of a circuit board having a first mounting hole and a plurality of circuit board holes adjacent to the mounting hole; and a connector block having an insulating body with a mounting surface engaging one side of the circuit board at the mounting hole, a first flexible snap latch unitary with and projecting outwardly of the body, and a series of contact terminals within the body with each terminal including a terminal tail extending outwardly of the body, past the mounting surface and into one of the circuit board holes, the snap latch being formed from a heat-shrink plastic material and including a pair of elongate and longitudinally shrunk tensile prongs and radially outwardly facing latches on the ends of the prongs, the prongs extending through the first mounting hole and the latches engaging the other side of the circuit board, whereby the snap latch secures the block tightly against the circuit board.

2. The combination of claim 1 wherein the snap latch is integral with the insulating body.

3. The combination of claim 1 wherein the snap latch includes latch means engagable with a latching surface on the insulating body.

4. The combination of claim 3 including a second snap latch like and spaced from said first snap latch and a second mounting hole like and spaced from said first mounting hole, said second snap latch extending through the second mounting hole and engaging the circuit board in the same manner the first snap latch extends through the first mounting hole and engages the circuit board, said snap latches cooperating to secure the block tightly against the circuit board.

5. The combination of claim 4 wherein each snap latch includes a cylindrical central portion seated within a step formed in the insulating body and opening at the mounting surface, and a flat on the side of the central portion whereby roughness on the flat formed during molding of the snap latches is located below the surface of the cylindrical portions of the snap latches and does not interfere with seating of the central portions within the recesses.

* * * * *